United States Patent [19]

Bogese, II et al.

[11] Patent Number: 4,874,330

[45] Date of Patent: Oct. 17, 1989

[54] CAPACITY MODULAR PLUG

[75] Inventors: Stephen B. Bogese, II; Charles E. Hall, both of Roanoke, Va.

[73] Assignee: Virginia Plastics Company, Roanoke, Va.

[21] Appl. No.: 318,514

[22] Filed: Mar. 3, 1989

Related U.S. Application Data

[63] Continuation of Ser. No. 178,853, Mar. 29, 1988, abandoned, which is a continuation of Ser. No. 73,294, Jul. 7, 1987, abandoned, which is a continuation of Ser. No. 805,571, Dec. 2, 1985, abandoned, which is a continuation of Ser. No. 588,565, Mar. 12, 1984, abandoned.

[51] Int. Cl.[4] ..... H01R 4/24

[52] U.S. Cl. ..... 439/418

[58] Field of Search ..... 439/389–426

[56] References Cited

U.S. PATENT DOCUMENTS

| | | | |
|---|---|---|---|
| 3,720,778 | 3/1973 | Woertz et al. | 339/99 R |
| 3,954,320 | 5/1976 | Hardesty | 339/99 R |
| 4,418,977 | 12/1983 | O'Shea, Jr. | 339/99 R |
| 4,424,403 | 1/1984 | Bogese, II | 339/99 R |

*Primary Examiner*—Joseph H. McGlynn

*Attorney, Agent, or Firm*—Saidman, Sterne, Kessler & Goldstein

[57] ABSTRACT

An improved modular plug which permits a normal 6-position plug to accommodate 8 conductors, and a normal 8-position plug to accommodate 10 conductors, without increasing the overall outer width thereby remaining in compliance with FCC regulations. A pair of grooves are formed into the side walls of the cable-receiving cavity to accommodate the extra conductors.

20 Claims, 3 Drawing Sheets

CAPACITY MODULAR PLUG

This application is a continuation, of application Ser. No. 07/178,853, filed Mar. 29, 1988, now abandoned, which is a continuation, of application Ser. No. 073,294, filed 7/7/87, now abandoned, which is a continuation, of application Ser. No. 805,571, filed Dec. 2, 1985, now abandoned, which is a continuation, of application Ser. No. 588,565, filed Mar. 12, 1984, now abandoned.

BACKGROUND OF THE INVENTION

1. Field of the Invention

The present invention is related to electrical connectors, and more particularly is directed towards a new and improved telephone-type modular plug that mates with a telephone-type modular jack.

2. Description of the Related Art

Electrical connectors known as modular plugs and modular jacks have recently come into widespread use in the telecommunications industry. As utilized herein, the terms "modular plug" and "modular jack" connote the miniature interchangeable, quick-connect-and-disconnect plugs and jacks developed by Western Electric Company and Bell Telephone Laboratories originally for use with telephone equipment. See, for example, U.S. Pat. Nos. 3,699,498; 3,850,497; and 3,860,316. The word "modular" came to connote these types of plugs and jacks because they "modularized" the telephone equipment (handsets, desksets, cordsets, mounting plates, and the like) with which they were utilized. That is, modular plugs and modular jacks enable telephone equipment to be manufactured with standard connectors to permit interchangeability of components by consumers or end users without requiring a serviceman.

Modular plugs and jacks are now widely used to interconnect electrical components other than telephones. For example, a microcomputer may employ modular jacks in the computer housing for coupling the computer to various peripheral devices (modems, printers, disc drives, etc.) via cordsets terminated by modular plugs. Some of these peripheral components, such as a data modem, require only a 6-position plug, while other components, such as a printer, require an 8-position plug. Further, the dimensions of modular plugs and jacks that interconnect with telephone equipment is strictly governed by Part 68 of the rules of the Federal Communications Commission (FCC). For example, the width of a regular, 6-position modular telephone plug is about 0.380 inch, while the width of a regular 8-position modular telephone plug is about 0.460 inch, as established by the FCC.

Accordingly, two differently sized modular plug and jack combinations normally need to be provided to a computer manufacturer seeking to utilize, for example, a 6-position plug for a data modem and an 8-position plug for a printer connection. The requirement for two differently sized parts naturally increases the cost of tooling and assembly. Further, an 8-position plug and jack undesirably take up more space than their 6-position counterparts.

It would be highly desirable if a single size modular plug could be provided which both meets all FCC size limitations and is usable, for example, as either a 6-position connector or an 8-position connector. Tooling and assembly costs would be substantially reduced in that one part could be adapted to do the job previously required by two parts.

In addition, certain interconnect applications utilizing modular plugs require shielded multiconductor cables of the type described, for example, in copending application Ser. No. 246,165, filed March 23, 1981. In such a cable, one of the conductors is a drain wire consisting of an uninsulated conductor that is terminated together with the insulated conductors by the contact terminals of the modular plug. In those applications requiring communications through the telephone network, there are usually a predefined number of telephone network positions in the modular plug (e.g., 4 or 6) where the "active", information-carrying conductors are placed. In order to prevent possible harm to the telephone network when using a shielded cable having a drain wire, it would be highly desirable if the uninsulated drain conductor could be terminated in the modular plug in a position not normally occupied by an active, information-carrying conductor.

It is towards overcoming the above-noted deficiencies and achieving the stated objectives that the present invention is advanced.

SUMMARY OF THE INVENTION

The foregoing and other objects and features are achieved in accordance with one aspect of the present invention through the provision of a modular plug which comprises a one-piece rigid dielectric housing having a free end for insertion into a mating modular jack. The jack includes a plug-receiving opening with a tab-receiving latch and a plurality of spring contact members in the opening. The modular plug further includes a movable locking tab that extends angularly rearwardly from the free end of the housing and which is adapted to mate with the tab-receiving latch in the jack. A cable input end is also provided for receiving a multi-conductor cable that includes an outer insulating jacket. The plug also includes a terminal receiving side having a plurality of slots for receiving substantially planar contact terminals that have insulation-piercing tangs at the lower portion thereof for terminating the conductors of the cable and an upper portion for making electrical contact with the spring contact members of the mating modular jack. The plug further includes a cable-receiving cavity defined by first and second substantially planar side walls and top and bottom walls, the cavity including a forward region insertable into the jack during mating. A plurality of conductor-receiving troughs are provided in the cavity in the forward region thereof for receiving less than all of the conductors of the cable. The plug further includes first and second grooves extending longitudinally in the first and second planar side walls of the cavity in at least the forward region thereof. The grooves are each sized to receive an additional conductor from the multi-conductor cable.

In accordance with other aspects of the invention, the grooves extend longitudinally in the side walls both in the forward region and the rear region of the cavity. The conductor-receiving troughs and the first and second grooves lie in a substantially horizontal plane, all of the troughs being positioned between the first and second grooves that lie respectively on the outer edges of the troughs.

In one preferred embodiment of the present invention, the width of the free end of the housing is approximately 0.380 inch, the number of the conductor-receiving troughs is 6, and the cavity is capable of accommodating up to 8 conductors from the cable. In this embodiment, a normal 6-position plug may also be used as an 8-position plug.

In accordance with another embodiment of the present invention, the width of the free end of the housing is approximately 0.460 inch, the number of the conductor-receiving troughs is 8, the cavity is capable of accommodating up to 10 conductors from the cable, whereby a normal 8-position plug may also be used as a 10-position plug.

In accordance with other aspects of the present invention, the rear region of the cavity is of sufficient dimensions to accommodate the cable with its outer jacket, while a portion of the forward region is only of sufficient dimensions to accommodate the individual insulated or uninsulated conductors of the cable. The forward region preferably includes a transition section at the rear thereof for coupling to the rear region.

Protrusion means may be formed on an outer wall of the housing for keying the plug to a similarly-keyed jack. In accordance with another aspect of the invention, the rear region of the plug, being not normally insertable into the jack, may be of a greater width than the forward region.

BRIEF DESCRIPTION OF THE DRAWINGS

The foregoing and other objects, aspects and features of the present invention will be more fully appreciated as the same becomes better understood when considered in connection with the detailed description of the present invention viewed in conjunction with the accompanying drawings, in which.

DETAILED DESCRIPTION OF THE PREFERRED EMBODIMENTS

Figure 1:
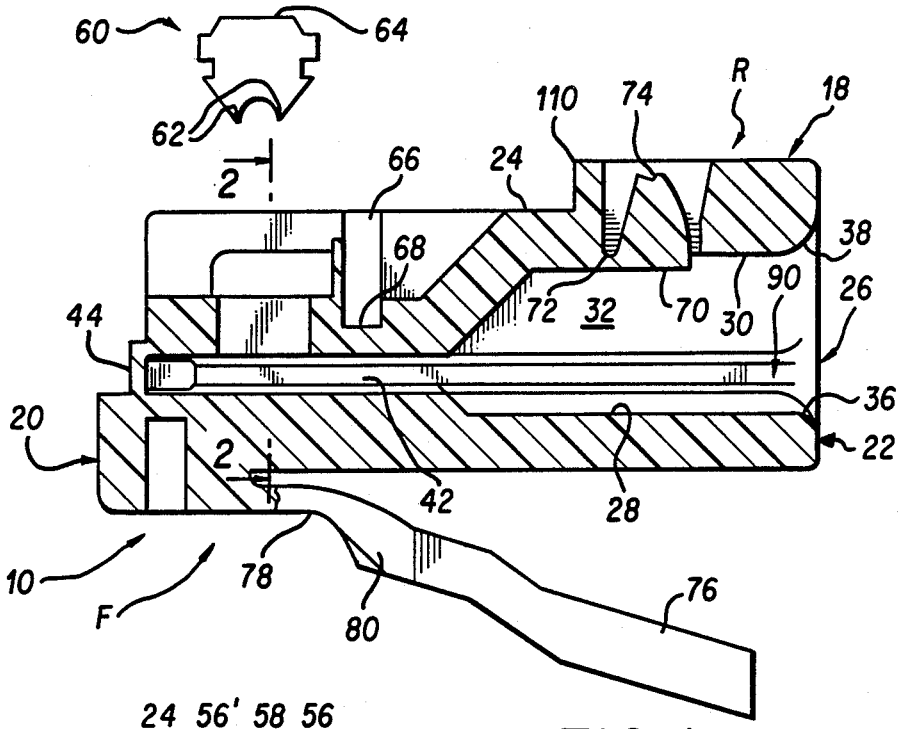
FIG. 1 is a longitudinal sectional view of a preferred embodiment of the improved modular plug of the present invention.
Figure 2:
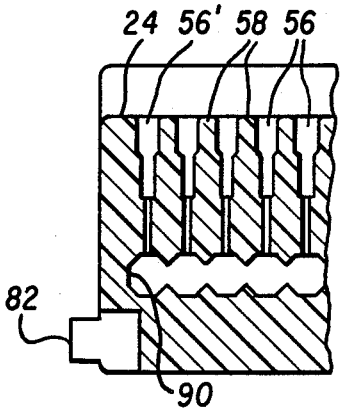
FIG. 2 is a partially cut-away, cross-sectional view of the preferred embodiment of FIG. 1 taken along line 2—2 thereof.

Referring now to the drawings, wherein like reference numerals represent identical or corresponding parts throughout the several views, and more particularly to FIGS. 1 through 4 thereof, there is illustrated a first preferred embodiment of the present invention which includes an electrical connector known as a modular plug that is indicated generally by reference numeral 10.

Modular plugs designed for telephone applications are all governed by Part 68 of the FCC regulations and are usually provided as 4-position, 6-position or 8-position units (which refers to the number of conductors terminated in the plug). Modular plug 10 is of the same general construction as set forth in U.S. Pat. No. 3,954,320 to Hardesty, and U.S. Pat. No. 4,412,715 to Bogese, II, both of which are expressly incorporated herein by reference. More particularly, modular plug 10 comprises an electrical connector for terminating a cable or cord 12 which includes a plurality of normally insulated conductors 14 that may be positioned either in a substantially circular array or in a substantially planar array within an outer insulating jacket 16. The cable may also include one or more uninsulated conductors, such as a drain wire for a shielded cable.

Plug 10 includes a one-piece or unipartite rigid dielectric housing indicated generally by reference numeral 18. Housing 18 includes a free end 20 for insertion into a mating modular jack of the same general construction as described in U.S. Pat. No. 3,850,497 to Krumreich et al., which is also expressly incorporated herein by reference. The modular jack with which the modular plug of the present invention may be utilized may also be of the type that permits direct coupling to a printed circuit board, as described in for example U.S. Pat. No. 4,210,376 to Hughes et al., also incorporated herein by reference. Such a modular jack typically includes a plurality of side-by-side conductors having spring contact portions that extend into a cavity sized to receive the free end 20 of plug 10 for making electrical contact with the plug's contact terminals, to be described in greater detail below.

Figure 3:
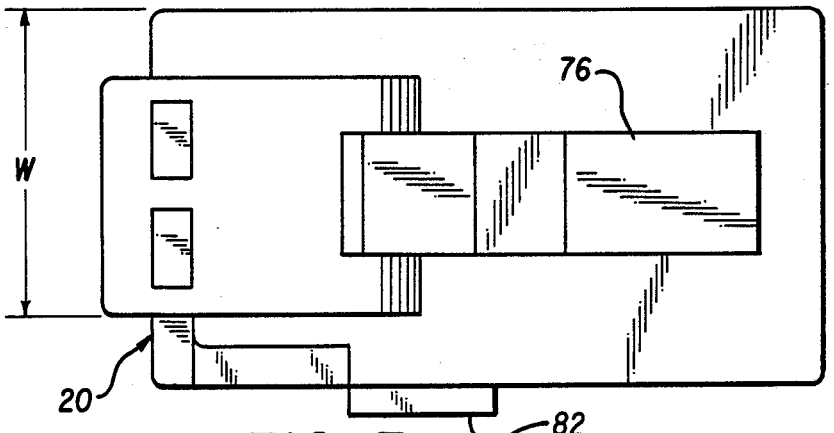
FIG. 3 is a bottom view of the preferred embodiment illustrated in FIG. 1.
Figure 4:
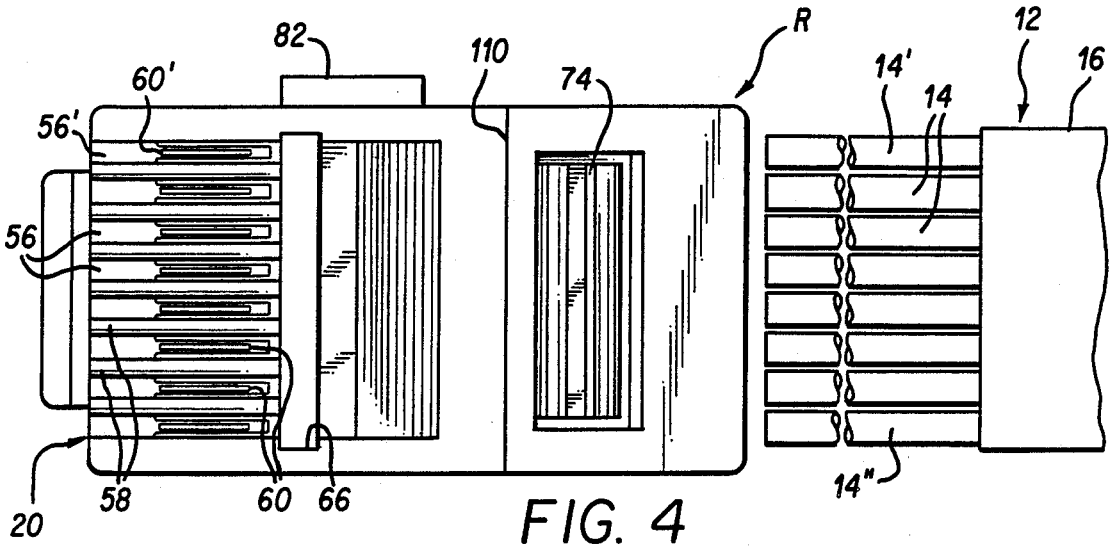
FIG. 4 is a top view of the preferred embodiment illustrated in FIG. 1 shown together with a flat multi-conductor cable.
Figure 5:
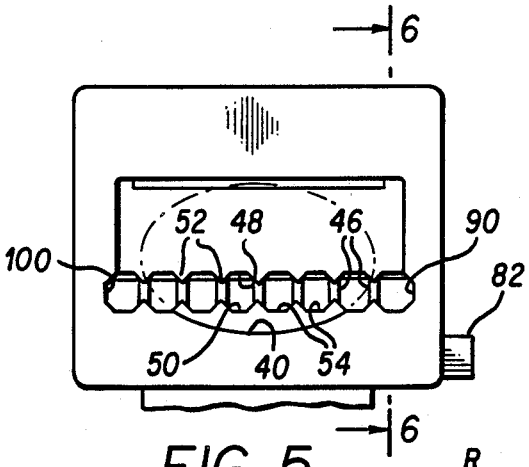
FIG. 5 is an end view of the preferred embodiment of FIGS. 1–4.

As seen most clearly in FIG. 3, free end 20 of plug 10 has an outer width W whose maximum dimension for telephone network interconnection is established by Part 68 of the FCC rules. For example, in a normal 6-position modular plug, W=0.380 inch while for a normal 8-position modular plug, W=0.460 inch. Naturally, with space economy of paramount concern in today's constantly more compact designs, it would be highly advantageous if more than 6 or 8 conductors could somehow respectively be accommodated in the existing 6 and 8-position modular plugs while still complying with FCC dimensional restrictions.

The plug 10 of the present invention also includes a cable input end 22 and a terminal receiving side 24. Cable input end 22 includes a cable-receiving cavity 26 within which multiconductor cable 12 is received. Cavity 26 includes a forward region F which, when plug 10 is mated with its modular jack, lies normally inside the plug-receiving opening of the jack, and rear region R which normally lies outside the modular jack housing. Wall 110 generally defines the boundary between the forward region F and the rear region R of the cable-receiving cavity 26.

Cavity 26 is further defined by opposed bottom and top walls 28 and 30 and a pair of substantially parallel, normally planar, opposed side walls 32 and 34. Bottom and top walls 28 and 30 terminate (i.e., at 22) in flared top and bottom entrance portions 36 and 38 (see also FIG. 6) to prevent sharp bends from damaging cord 12.

Figure 6:
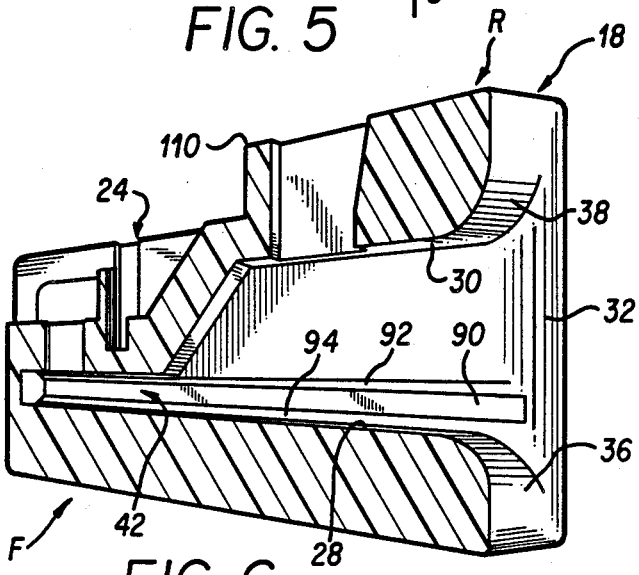
FIG. 6 is a perspective, sectional view of the preferred embodiment of FIG. 5 taken along line 6—6 thereof.
Figure 7:
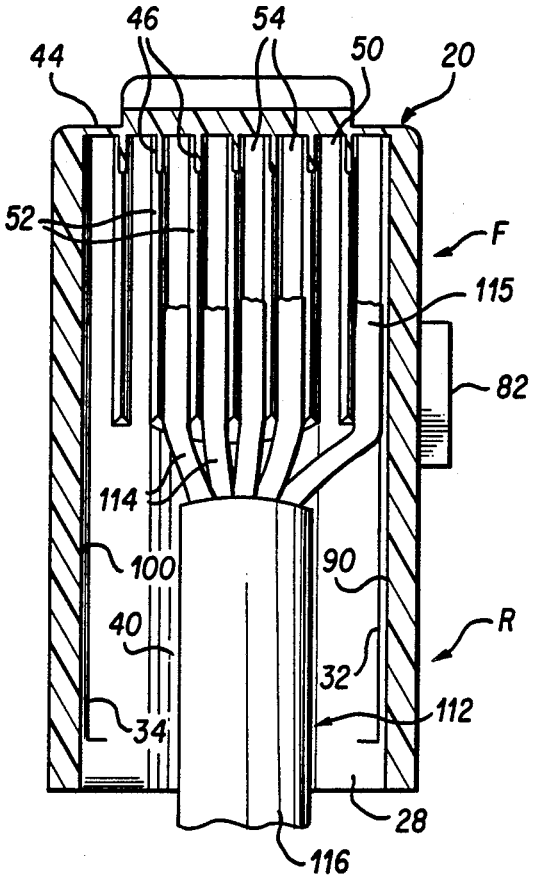
FIG. 7 is a longitudinal sectional view of the preferred embodiment of FIG. 1 shown together with a round, multi-conductor shielded cable.

As seen best in FIGS. 6 and 7, bottom wall 28 preferably includes an arcuate depression 40 for accommodating a round cable or cord assembly 112. Round cable 112 may comprise, for example, a shielded cable assembly as set forth in copending application Ser. No. 246,165. Forwardly of the depression 40 is positioned a reduced height section 42 at the forward region F of the cavity 26 within which the conductors of the cable are received after the cable's outer jacket has been stripped back. At the free end 20 of housing 18, cavity section 42 is preferably closed off by an end wall 44 from the inside surface of which extend a plurality of spaced dividing walls 46 which align and receive the ends of cable conductors therebetween.

Cavity section 42 is further defined by opposed internal end walls that include upper wall 48 and lower wall 50. Upper and lower walls 48 and 50 in turn each preferably include a plurality of longitudinally extending partitions 52 which form a plurality of conductor-receiving troughs 54 therebetween. Partitions 52 are preferably aligned with dividing walls 46 to insure accurate alignment of the cable conductors with their respective contact terminals 60, to be described below.

Referring back to FIG. 2, the terminal receiving side 24 of housing 18 includes a plurality of side-by-side terminal-receiving slots 56 defined by partitions 58 therebetween. Each slot 56 is adapted to receive and retain a substantially planar contact terminal 60 (FIG. 1) by a press or interference fit in a reduced-width portion of slot 56. Each contact terminal 60 includes insulation-piercing tangs 62 at the lower end thereof for making contact with the cable conductor and a spring contact matable surface 64 at the other end thereof for making contact with the similarly-spaced spring contact portions of the conductors of the mating modular jack, as described above.

Housing 18 further includes an opening 66 formed on the terminal receiving side 24 just rearwardly of slots 56. Opening 66 defines a conductor restraining bar 68 at the lower portion thereof which may, if desired, form a strain relief element for the cable conductors within cavity section 42.

Rearwardly of opening 66 is positioned a jacket anchoring member 70 which is connected to housing 18 by a hinge 72. Member 70 includes a snap-lock ledge 74 which cooperates with the upper wall 30 of cavity 26 such that upon engagement of member 70 by an appropriate tool, the lower face thereof is forced against the jacket 16 to provide strain relief within cavity 26.

Also conventionally provided is a locking tab or latching arm 76 pivotally mounted to the free end 20 of housing 18 at 78 and extending obliquely rearwardly. Latching arm 76 includes spaced shoulders 80 adapted to be secured by simlarly spaced shoulder-retaining or latch members in the mating modular jack.

A protrusion 82 may also be provided on an outer wall of housing 18 for allowing the plug 10 to be keyed to a particular modular jack having means for receiving protrusion 82.

The present invention provides an improvement over the substantially conventional structure described hereinabove. In the designs of the prior art, the maximum number of conductors 14 that could be accommodated in a housing having a width W of 0.380 inch was 6, while the maximum number for a housing having a width W of 0.460 inch was 8. In the present invention, it is possible to accommodate eight conductors in a housing having a width W equal to about 0.380 inch, while it is possible to accommodate 10 conductors in a housing having a width W equal to about 0.460 inch. In other words, in accordance with the present invention, a normal 6-position housing may be used either as a 6-position connector or an 8-position connector, while a normal 8-position housing may be used either as an 8-position connector or a 10-position connector. Obviously, this concept may be extended to connectors of other sizes.

As stated above, the side walls 32 and 34 of the cable-receiving cavity 26 are normally substantially planar. In accordance with the present invention, however, a pair of grooves 90 and 100 are formed longitudinally in side walls 32 and 34 respectively, adjacent, on both sides of and in alignment with the plurality of troughs 50. Grooves 90 and 100 are each designed to accommodate an additional conductor, such as conductors 14' and 14'' (FIG. 4), of the multi-conductor cable.

Each groove, for example, groove 90, preferably includes top and bottom bevelled surfaces 92 and 94, respectively, to simulate the partitions 52 and help position the two "extra" end conductors 14' and 14''.

Figure 8:
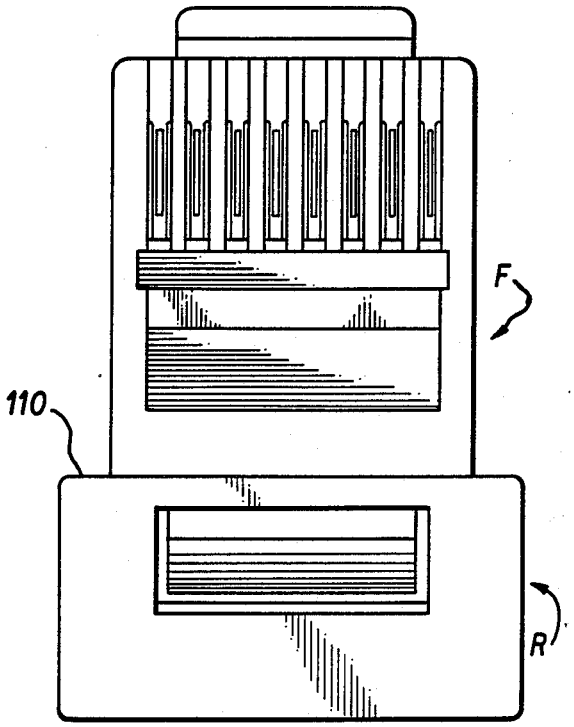
FIG. 8 is a top view of an alternate embodiment of the present invention.

To accommodate the new groove 90 and the conductor 14' therein, an extra slot 56' (FIG. 2) is provided in the terminal receiving side 24 of housing 18, and of course an extra contact terminal 60' (not illustrated) will be necessary to terminate conductor 14'. The same holds true for the conductor 14'' at the other end of flat cable 12. It is also noted that although side wall 32 of cavity 26 has a reduced thickness at the location of groove 90, it remains substantially the same thickness elsewhere. Further, it is not necessary that grooves 90 and 100 extend the entire length of side walls 32 and 34. They need only extend in the forward region F of the cavity which is the region that must be sized to fit within the plug-receiving cavity of the mating modular jack. From wall 110 rearwardly, the rear region R may be enlarged in width as illustrated in FIG. 8 to provide a greater outer wall thickness for the additional conductors. In the embodiment of FIG. 8, the overall width of the rear portion R may exceed that of front portion F by, for example, 0.100 inch. This provides added support for the cable where it enters the plug.

Figure 9:
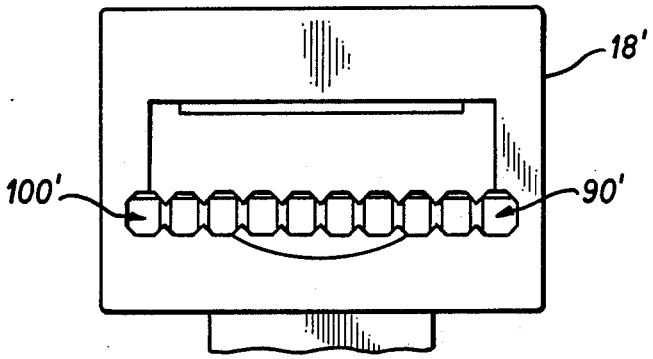
FIG. 9 is an end view similar to FIG. 5 but illustrating yet another alternate embodiment of the present invention.

Illustrated in FIG. 9 is an alternate embodiment whereby a "normal" 8-position plug 18' has been converted into a 10-position plug by the addition of two grooves 90' and 100'.

It is not necessary that the conductors from a cable occupy all positions available in the plug. For example, the round shielded cable 112 illustrated in FIG. 7 may include a plurality of insulated conductors 114 and an uninsulated, drain wire 115 that contacts a foil shield (not shown) wrapped about the conductors inside the outer jacket 116. (The conductors 114 and 115 extend to end wall 44 but are shown broken away to aid understanding.) In this particular use, the four insulated conductors 114 occupy the four "center" troughs 54 which would be the normally active, information-carrying conductor positions when plug 10 is interconnected with the telephone network. By enabling placement of the uninsulated drain wire 115 in groove 90 of the present invention, the possibility that a ground potential will be accidentally introduced onto an information-carrying conductor is advantageously minimized while still maintaining FCC dimensional restrictions on a 6-position modular plug.

By virtue of the foregoing, we have provided a modular plug which, for a given size, can do the work of a bigger connector. In this way, a modular plug previously limited by FCC regulations to accommodate a maximum of 6 conductors can be configured to accommodate either 6 or 8 conductors to be utilized, for example, as either a data modem plug or a printer plug. Alternatively, a normal 8-position plug can be configured for either 6, 8 or 10 conductors. This uniformity and versatility substantially reduces tooling and assembly costs, saves considerable space, and reduces the risk of telephone network damage when employing shielded cables having drain or ground conductors.

Obviously, numerous modifications and variations of the present invention are possible in light of the above teachings. It is therefore to be understood that within the scope of the appended claims, the invention may be practiced otherwise than as specifically described herein.

We claim as our invention:

1. In a modular plug characterized by a unipartite rigid dielectric housing having a free end for insertion in a mating modular jack, a movable locking tab extending angularly rearwardly from the free end of the housing and adapted to mate with a tab-receiving latch in the modular jack, a cable input end for receiving a multi-conductor cable having an outer jacket, a terminal receiving side having plurality of slots for receiving substantially planar contact terminals having insulation-piercing tangs at the lower portion thereof for terminating the conductors of the cable and an upper portion for making electrical contact with the spring contact members of the mating modular jack, a cable receiving cavity defined by first and second substantially planar side walls and top and bottom walls, said cavity including a forward region that is insertable into the mating modular jack and a rear region that is not normally insertable into the mating modular jack, said cavity including in the forward region thereof a plurality of conductor-receiving troughs.

the improvement which comprises first and second conductor-receiving grooves formed in the first and second side walls of the cavity of said housing, said grooves each extending longitudinally in said side walls and being substantially parallel to the conductor-receiving troughs;

said grooves each sized to receive one of the conductors of said multi-conductor cable, the number of conductors which can be received in the cavity being greater than the number of troughs formed in said housing.

2. The improved modular plug as set forth in claim 1, wherein said grooves extend longitudinally in said side walls in said forward region and said rear region.

3. The improved modular plug as set forth in claim 1, wherein said housing includes protrusion means formed on an outer wall thereof for keying said plug to a particular keyed jack.

4. The improved modular plug as set forth in claim 1, wherein said rear region of said plug is of a greater width than said forward region.

5. The improved modular plug as set forth in claim 1, wherein said plurality of conductor-receiving troughs and said first and second grooves lie in a plane.

6. The improved modular plug as set forth in claim 5, wherein all of said troughs are positioned between said first and second grooves.

7. The improved modular plug as set forth in claim 6, wherein the width of said free end of said housing is approximately 0.380 inch, the number of said troughs is six, and said cavity is capable of accommodating up to eight conductors from the cable.

8. The improved modular plug as set forth in claim 6, wherein the width of said free end of said housing is approximately 0.460 inch, the number of troughs is eight, and said cavity is capable of accommodating up to ten conductors from the cable.

9. The improved modular plug as set forth in claim 1, wherein said rear region of said cavity is of sufficient dimensions to accommodate the cable with its outer jacket, while a portion of said forward region is only of sufficient dimensions to accommodate the conductors of the cable.

10. The improved modular plug as set forth in claim 9, wherein said forward region includes a transition section at the rear thereof to couple to said rear region.

11. A modular plug for terminating a cable having a plurality of conductors, comprising:

a unipartite rigid dielectric housing having a free end for insertion into a mating modular jack;

the mating modular jack including a plug-receiving opening with a tab-receiving latch and a plurality of spring contact members in said opening;

the plug further comprising:

a movable locking tab extending angularly rearwardly from said free end of said housing and adapted to mate with the tab-receiving latch in the modular jack;

a terminal receiving side having a plurality of slots;

substantially planar contact terminals in said slots and having insulation-piercing tangs at the lower portion thereof for terminating the conductors of the cable and an upper portion for making electrical contact with the spring contact members of the modular jack;

a cable-receiving cavity defined by first and second side walls and top and bottom walls;

said cavity including a forward region that is insertable into the modular jack and a rear region that is not normally insertable into the modular jack;

said cavity including in said forward region thereof a plurality of conductor-receiving troughs, the number of troughs being less than the number of conductors which can be received in the cavity, a conductor-receiving groove extending longitudinally in said first side wall, in at least said forward region of said cable receiving cavity;

said groove sized to receive one of the conductors of said multi-conductor cable.

12. The modular plug of claim 11, wherein said grooves extend longitudinally in said side walls in said forward region and said rear region.

13. The modular plug of claim 11, wherein said housing includes protrusion means formed on an outer wall thereof for keying said plug to a particular keyed jack.

14. The modular plug of claim 11, wherein said rear region of said plug is of a greater width than said forward region.

15. The modular plug of claim 11, wherein said plurality of conductor-receiving troughs and said first and second grooves lie in a plane.

16. The modular plug of claim 15, wherein all of said troughs are positioned between said first and second grooves.

17. The modular plug of claim 16, wherein the width of said free end of said housing is approximately 0.380 inch, the number of said troughs is six, and said cavity is capable of accommodating up to eight conductors from the cable.

18. The modular plug of claim 16, wherein the width of said free end of said housing is approximately 0.460 inch, the number of said troughs is eight, and said cavity is capable of accommodating up to ten conductors from the cable.

19. The modular plug of claim 11, wherein said rear region of said cavity is of sufficient dimensions to accommodate the cable with its outer jacket, while a portion of said forward region is only of sufficient dimensions to accommodate the conductors of the cable.

20. The modular plug of claim 19, wherein said forward region includes a transition section at the rear thereof to couple to said rear region.

* * * * *